United States Patent [19]

Kuiper

[11] Patent Number: 4,606,729

[45] Date of Patent: Aug. 19, 1986

[54] METHOD OF MANUFACTURING A DEFLECTION UNIT FOR COLOR TELEVISION DISPLAY TUBES WHICH IS PRE-ADJUSTED FOR COLOR PURITY

[75] Inventor: Albert J. Kuiper, Eindhoven, Netherlands

[73] Assignee: U.S. Philips Corporation, New York, N.Y.

[21] Appl. No.: 200,667

[22] Filed: Oct. 27, 1980

Related U.S. Application Data

[63] Continuation of Ser. No. 47,978, Jun. 13, 1979, abandoned.

[30] Foreign Application Priority Data

Jun. 30, 1978 [NL] Netherlands ..... 7807176

[51] Int. Cl.[4] ..... H01J 9/236

[52] U.S. Cl. ..... 445/3; 445/33; 445/36; 335/211

[58] Field of Search ..... 29/25.11, 25.13, 25.16; 316/1, 23, 29; 335/211-212; 445/36

[56] References Cited

U.S. PATENT DOCUMENTS

| | | | |
|---|---|---|---|
| 2,494,459 | 1/1950 | Torsch | 335/211 |
| 2,704,816 | 3/1955 | Fernsler | 335/211 |
| 3,098,943 | 7/1963 | Reiches | 335/211 |
| 3,369,201 | 2/1968 | Fiore et al. | 324/20 |
| 3,810,053 | 10/1974 | McGlashan | 335/212 |

*Primary Examiner*—Kenneth J. Ramsey

*Attorney, Agent, or Firm*—Thomas A. Briody; William J. Streeter; Leroy Eason

[57] ABSTRACT

A deflection unit for a color television display tube comprising line and frame deflection coils and a magnet core cooperating with said coils can be manufactured by placing the deflection coils and the magnet core around the part of the transition neck-cone of a color display tube in such manner that the deflection coils engage or substantially engage the tube, which display tube comprises an adjusted color purity magnet, after which the tube is adjusted so as to be color pure by moving the magnet core along the axis of the tube, after which, if desired, the magnet core is moved in known manner in a plane perpendicular to the tube axis so as to remove convergence errors and the magnet core and the coils are then connected together to form the deflection unit.

3 Claims, 4 Drawing Figures

METHOD OF MANUFACTURING A DEFLECTION UNIT FOR COLOR TELEVISION DISPLAY TUBES WHICH IS PRE-ADJUSTED FOR COLOR PURITY

This is a continuation of application Ser. No. 47,978, filed June 13, 1979, now abandoned.

BACKGROUND OF THE INVENTION

The invention relates to a method of manufacturing a deflection unit for a colour television display tube, of the type having a neck portion containing means for generating a plurality of electron beams and a cone portion with a display screen remote from said neck portion, and further having a pre-adjusted colour purity magnet, said deflection unit comprising line and field deflection coils and a magnetic core which cooperates with said deflection coils.

The invention also relates to a deflection unit manufactured according to the method and to the combination of such a deflection unit with a colour display television tube.

One method is known from the Philips Product Information "Adjustment of Colour T.V. Picture Tubes", pp.9 and 10, Philips Electronic Components and Materials Division. There it is described that the colour purity depends on the axial position of the deflection unit and on the magnetic field of a colour purity magnet. The influence of the colour purity magnet extends over the whole display screen, but axial displacement of the deflection unit has no effect on the colour purity in the center of the display screen. Therefore the colour purity is first adjusted in the center of the display screen by means of the colour purity magnet and the colour purity over the whole screen is then adjusted by moving the deflection unit along the tube axis.

In another prior art device, a deflection unit, the magnetic core of the deflection unit consists of a number of adjustable segments. The segments can be moved with respect to each other in the axial direction or in a plane perpendicular to the display tube longitudinal axis. Small convergence errors can be removed by moving the segments. A construction with separate movable segments is very complicated and hence not suited for series production. The colour purity adjustment of this tube and deflection unit takes place in the manner already described by moving the deflection unit along the tube axis.

Since nowadays it is possible to manufacture the display tube envelopes with very small tolerances, it is possible to provide them with deflection units which are adjusted so as to be colour pure and which, when mounted on said identical display tubes, need no longer be adjusted so as to provide a colour pure display. It is also possible to secure adjusted deflection units rigidly to the display tube.

SUMMARY OF THE INVENTION

It is therefore an object of the invention to provide a method of manufacturing separate deflection units which are adjusted so as to be "colour pure" and also to provide deflection units which have been so adjusted.

According to the invention this method is characterized in that the deflection coils and the magnet core are placed around the part of the transition neck-cone of the colour display tube in such manner that the deflection coils engage or substantially engage the tube, after which the tube is adjusted so as to be colour pure by energising said deflection coils and said display tube and moving the magnet core along the longitudinal axis of the tube, after which, if desired, the magnet core is moved in known manner in a plane perpendicular to the tube axis so as to remove dynamic convergence errors and then the magnet core and the coils are connected together.

The coils are provided against the display tube envelope or at a defined distance from the tube, for example against studs or against a centering rim. Instead of moving the coil and magnetic core together, only the magnetic core is moved in the axial direction until the tube has been adjusted so as to produce a substantially colour pure display. If convergence errors are still found, these can be removed in known manner, as described in U.S. Pat. No. 3,810,053, by moving the magnetic core in a plane perpendicular to the tube longitudinal axis. Coils and magnetic core are then secured to each other and together constitute a deflection unit which has been adjusted so as to be "colour pure".

Securing the magnetic core and deflection coils together to form a deflection unit is preferably carried out by pouring or spraying a synthetic resin between the deflection coils and magnetic core which resin then hardens and/or cures. Other methods of securing may of course, be used.

DESCRIPTION OF THE DRAWINGS

The above and other features of the invention will now be described in greater detail by way of example with reference to the accompanying drawings, in which.

DESCRIPTION OF THE PREFERRED EMBODIMENT

Figure 1:
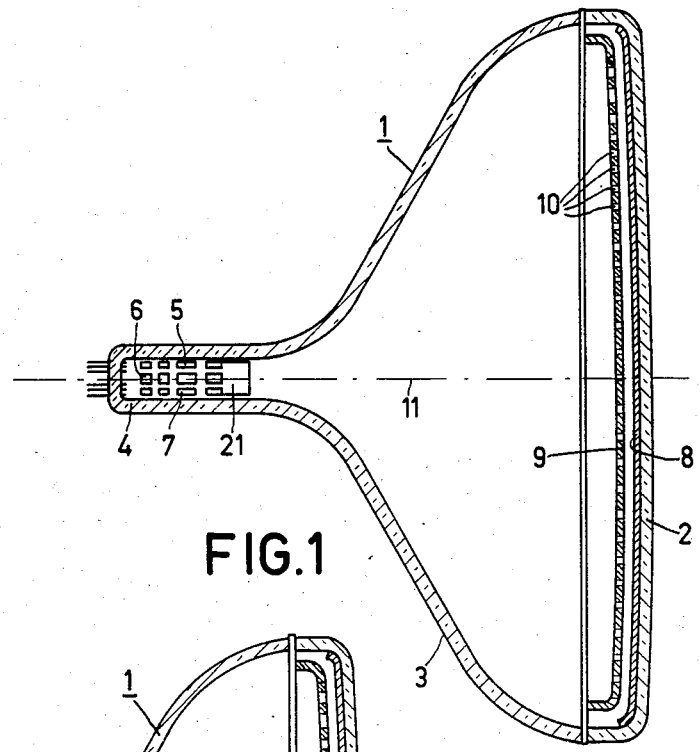
FIGS. 1 to 3 show diagrammatically the steps of the method according to the invention.

FIG. 1 is a longitudinal sectional view of a colour display tube. It consists of a glass envelope 1 which is composed of a display window 2, a cone 3 and a neck 4. Three electron guns 5, 6 and 7, situated with their axes in one plane, which is the plane of the drawing, for generating electron beams, are present in the neck 4. The outermost electron guns 5 and 7 are situated at equal distances from the central electron gun 6. The generated electron beams enclose a small angle with each other and pass through the apertures 10 in the colour selection electrode 9 after which they impinge on a display screen 8. Since the display screen 8 is composed of triplets of linear elements which luminesce in three different colours and the beams enclose a small angle with each other, each beam is incident only on elements of one colour. A colour display tube having a deflection unit is adjusted so as to produce a colour pure display if the electron beam destined for one colour does indeed impinge only on this colour throughout the screen. As already described, the colour pure adjustment has so far been carried out inter alia by moving the entire deflection unit axially (along the tube axis longitudinal 11).

Figure 2:
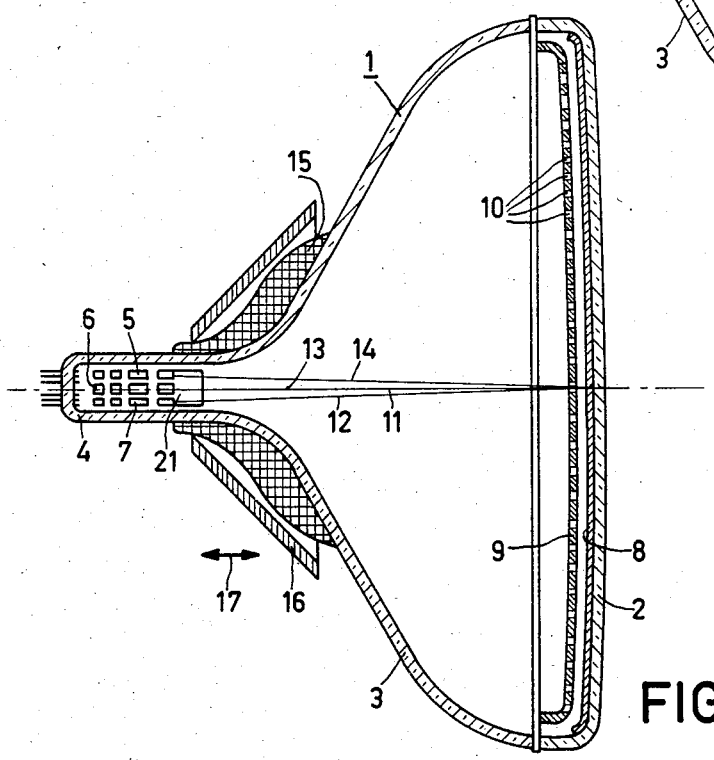
Figure 3:
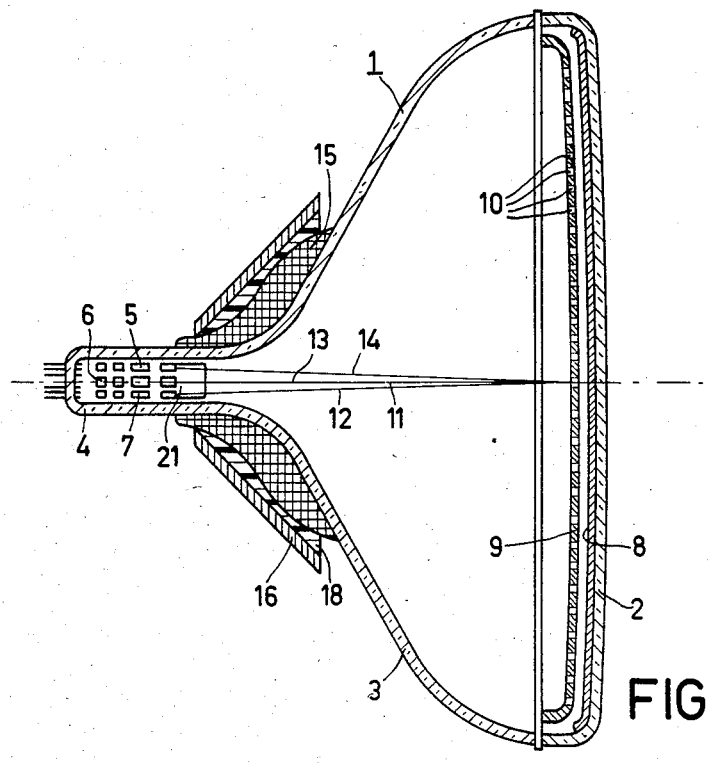

FIG. 2 shows a colour display tube according to FIG. 1 having a pre-adjusted colour purity magnet in a convergence sleeve 21. Deflection coils 15 and a magnetic core 16 are provided around the transition between neck 4 and cone 3 of the display tube, with which the electron beams 12, 13 and 14 can be deflected over the display screen 8. The magnetic core is movable axially with respect to the deflection coils 15 in the direction of the arrow 17. The method of manufacturing deflection units which are adjusted so as to produce a colour pure display is carried out as follows. Slide the deflection coils 15 onto the neck 4 and the cone 3 with the deflection unit and display tube energised. Move the magnetic core 16 axially 17 in such manner that the tube display is adjusted do as to be "colour pure". Movements of less than 1 to 2 mm are often sufficient so as to produce a colour pure display. If necessary, move the magnet core in addition in a plane perpendicular to the tube longitudinal axis so as to remove dynamic convergence errors and secure the coils and the magnet core together. This may be done, for example, by pouring or spraying a curing synthetic resin 18 between the coil 15 and the magnet core 16, as is shown in FIG. 3.

Figure 4:
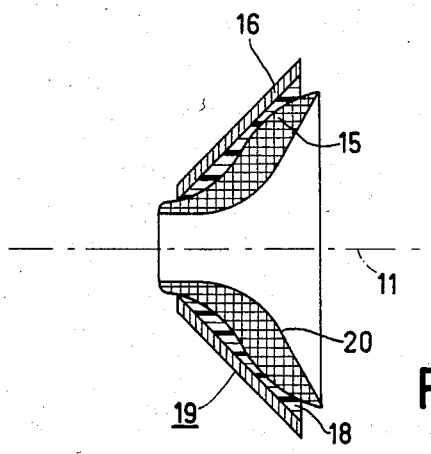
FIG. 4 shows an adjusted deflection unit.

After curing and/or hardening of the synthetic resin, the deflection unit 19 may be removed from the colour display tube. This deflection unit 19, as shown in FIG. 4, can now be combined with tubes which are identical to the standard colour display tube on which the deflection unit has been manufactured, in which colour purity adjustment may then be omitted.

It is also possible to rigidly secure the deflection unit to the display tube on which the deflection unit is adjusted so as to be colour pure and to use it as one assembly in a device for displaying coloured pictures.

What is claimed is:

1. A method of manufacturing a deflection unit for a color television display tube of the type having a neck portion containing means for generating a plurality of electron beams and a cone portion with a display screen remote from said neck portion, and further having a pre-adjusted color purity magnet, said deflection unit comprising line and field deflection coils and a magnet core which cooperates with said deflection coils, said method comprising placing said deflection coils around the transition neck-cone of said color display tube in such manner that said deflection coils substantially engage the tube, placing said magnet core over said deflection coils, adjusting said tube so as to be color pure by energizing said deflection coils and display tube and moving said magnet core along the longtitudinal axis of said tube with respect to said deflection coils to adjust for color purity, and securing together said magnet core and said deflection coils.

2. A method as claimed in claim 1, wherein said deflection coils and said magnet core are secured together by pouring or spraying a curing and/or hardening synthetic resin between said deflection coils and said magnet core.

3. A method for manufacturing a deflection unit as claimed in claim 1 which further comprises moving said magnet core in a plane perpendicular to the tube axis to remove convergence errors in the tube display.

* * * * *